United States Patent [19]

Bergmann

[11] 4,307,537

[45] Dec. 29, 1981

[54] AIRBORNE FLOATING LIFT-WEIGHT BALANCED TOY

[76] Inventor: David E. Bergmann, 722 E. 6th St., St. Paul, Minn. 55106

[21] Appl. No.: 225,470

[22] Filed: Jan. 16, 1981

Related U.S. Application Data

[63] Continuation of Ser. No. 36,342, May 7, 1979, abandoned.

[51] Int. Cl.[3] ..... A63H 3/06; A44C 3/00

[52] U.S. Cl. ..... 46/87; 40/2 R; 40/215; 46/74 D

[58] Field of Search ..... 46/87, 88, 89, 90, 94, 46/155, 74 D; 40/2 R, 214; 244/93; 114/121, 123

[56] References Cited

U.S. PATENT DOCUMENTS

| | | | |
|---|---|---|---|
| 1,508,420 | 9/1924 | Swartz et al. | 46/87 |
| 1,858,460 | 5/1932 | Ranseen | 46/87 |
| 2,327,665 | 8/1943 | Peat | 18/42 |
| 2,704,267 | 3/1955 | Tilden, Jr. | 154/52 |
| 3,075,243 | 1/1963 | Shiplet et al. | 18/9 |
| 3,591,975 | 7/1971 | Terc | 46/87 |
| 3,611,623 | 2/1970 | Copstead | 46/90 |
| 4,038,777 | 8/1977 | Schwartz | 46/87 |
| 4,077,588 | 3/1978 | Hurst | 244/31 |

*Primary Examiner*—Gene Mancene

*Assistant Examiner*—Michael J. Foycik

*Attorney, Agent, or Firm*—Kinney, Lange, Braddock, Westman and Fairbairn

[57] ABSTRACT

An airborne, free floating, lift-weight balanced toy for manual manipulation includes a closed envelope of polyethylene terephthalate (Mylar) filled with helium. The envelope is exactly counterbalanced with one or more ballast members so that the toy will assume a position at a desired distance from the floor or ground when it is let free. Such ballast members are made up of a plurality of weight control modules spirally arranged with respect to each other and held onto the skin of the toy by double face adhesive. In one form of the invention, when such a toy is initially filled with helium and a ballast member is in place, it will have a static balance such that one portion will always come back to being the bottom portion. In a second form, two ballast members are placed so that the toy will remain oriented in space in whatever position it is manually placed, if there are no outside effects except gravity and the lifting effect of the helium working on it. In each form, the ballast members are so positioned with respect to the skin of the toy that when one or more weight control modules are removed serially from the outer end of the spiral toward the inner end thereof, this static balance is not appreciably disturbed.

7 Claims, 5 Drawing Figures

AIRBORNE FLOATING LIFT-WEIGHT BALANCED TOY

This application is a continuation of my copending application Ser. No. 36,342, filed May 7, 1979 now abandoned.

BACKGROUND OF THE INVENTION

This invention has relation to a toy, amusement device or other object which has a fixed static balance and which can be manually or otherwise propelled and will then orient itself in accordance with this predetermined balance and will return to a predetermined altitude. Such an object will include a relatively light gas impervious envelope filled with a lighter-than-air gas to counterbalance the weight of the enveloping structure.

It is known to create an aerial toy which is lighter than air and has to be tethered to keep it from escaping. See U.S. Pat. No. 1,858,460 to Ranseen, granted in May of 1932.

It is known to use a lighter-than-air gas to counterbalance the weight of an encompassing structure to produce a toy which is substantially weightless. See U.S. Pat. No. 3,591,975 to Terc, granted in July of 1971; U.S. Pat. No. 3,611,623 to Copstead, granted in October of 1971; and U.S. Pat. No. 4,038,777 to Schwartz, granted in August of 1977.

In the patent to Copstead, an inflatable toy balloon is disclosed which is designed to be filled by an aerosol-type container charged with a supply of helium under pressure. The charge in the container is sufficient to supply helium in an amount calculated to approximately counterbalance the weight of the balloon when the entire contents of the container is discharged into the balloon. The balloon has relatively thick walls and is resilient and highly stretchable. Washer-like ballast elements are provided to friction fit over the resilient balloon charging nipple to approximately counterbalance the lifting effect of the helium. No provision is made for limiting the lifting power of the balloon by limiting the size of the balloon to a maximum.

The patent to Schwartz discloses a decorative object 10 which can be filled with a lighter-than-air gas to form a weightless decorative object. Polyethylene terephthalate is suggested as one of the materials from which the skin of the object can be made. The object 10 is counterbalanced by adding weights 20 into a gondola 19 which is supported from the bottom of the object 10 by a string 17. The object of the invention is to provide a decorative object or toy which will hover at any given height and, the patent teaches, will be particularly useful as a decoration in a closed room. The Schwartz patent does not show a structure which will be useful as a toy which can be thrown back and forth between players or which can be used outside and which, regardless of wind currents and violent throwing of the toy, will eventually return to a predetermined altitude.

The patent to Terc discloses a bulbous body of rubbery material which can be inflated as a balloon, and which can be counterbalanced with weights which are detachable from the balloon and which are held on the balloon in the first instance with an adhesive coating of the pressure sensitive type. No provision is contemplated for initially applying and removing the weights in such manner as to leave the dynamic and static balance of the inflatable toy unchanged as weights are added to and/or taken away from the toy to maintain the lift-weight balance of the toy at a desired altitude.

In the examination of my above-identified application, in addition to the patents to Ranseen, Terc, Copstead and Schwartz, the Examiner cited the following:

| U. S. PATENTS | | | |
|---|---|---|---|
| 4,077,588 | Hurst | March 1978 | 46/87 |
| 1,508,420 | Swartz et al | September 1924 | 41/87 |
| 2,704,267 | Tilden | March 1955 | 425/Digest 109 |
| 3,075,243 | Shipley | January 1963 | 425/Digest 109 |
| 2,327,665 | Peat | August 1943 | 425/Digest 109 |

Neither applicant nor those in privity with him know of any closer prior art than that identified above and/or discussed in this application or in the prosecution of the parent application; nor do they know of any prior art which anticipates the claims made herein.

BRIEF SUMMARY OF THE INVENTION

A toy or other object of the invention includes a gas filled compartment having an envelope made of a skin of a thin material which has the properties of being relatively light in weight, unstretchable, and substantially impermeable to a suitable lighter-than-air gas, such as helium, for example. One or more ballast members are adhered to the compartment at appropriate locations to establish a desired static balance of the object when it is in an airborne, floating, lift-weight balanced condition. At least one such ballast member consists of a plurality of weight control modules arranged in a symmetrical or spiral-like pattern, the modules being adhered to the skin of the toy in such a manner that they can be serially removed from the toy from the outer end of the spiral inwardly and reconnected to the toy from the inward end of the spiral outwardly as it is needed to maintain the original static balance of the toy as changes in the lifting power of the lighter-than-air gas require changes in the weight of the ballast member to maintain and/or reestablish the light-weight balance of the toy.

In a first form of the invention, a ballast member is situated at a lower portion of the toy and the balance of the toy is such that it will assume an "upright" position whenever it is free floating and out of the influence of air currents and the wind and out of the influence of players playing with the toy.

In the second form of the invention, more than one ballast member is utilized to maintain the toy in static equilibrium so that it will retain whatever position it is placed in when it is not under the influence of throwing action by a player or air or wind currents.

IN THE DRAWINGS

DESCRIPTION OF PREFERRED EMBODIMENTS

Figure 1:
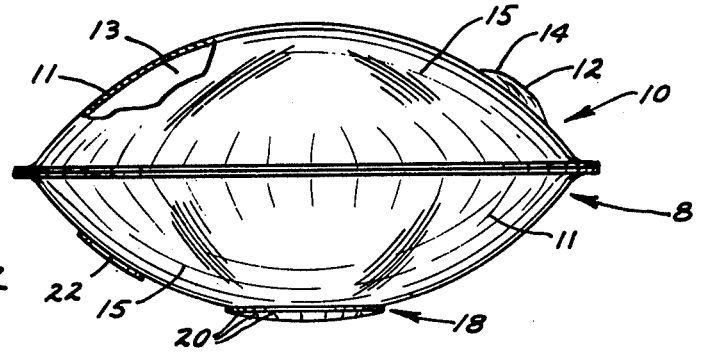
FIG. 1 is a side elevational view of an airborne, floating, lift-weight balanced toy made according to a first form of the invention.
Figure 2:
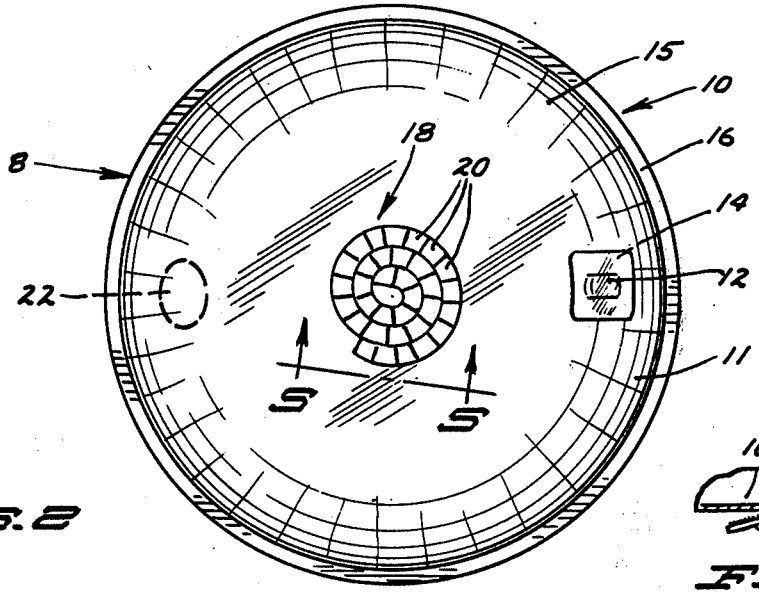
FIG. 2 is a top plan view of the airborne toy of FIG. 1.
Figure 5:
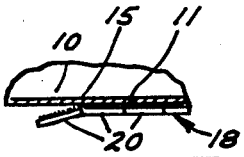
FIG. 5 is an enlarged sectional view taken on the line 5—5 in FIG. 2 and/or in FIG. 4.

First Form of the Invention:

As seen in FIGS. 1, 2 and 5, an airborne, floating, lift-weight balanced toy 8 of a first form of the invention includes a gas-filled envelope, cell or compartment 10 which can be made of a skin 11 of polyethylene terephthalate (sold under the trademark MYLAR) coated with a metallic film or can be made of any other material which also has the properties of being relatively light in weight and unstretchable and substantially impermeable to a suitable lighter-than-air gas 13 such as helium, for example. This gives the envelope, cell or compartment 10 the property of having a maximum volume when filled with lighter-than-air gas, which volume will not change with changes in the atmospheric pressure around the airborne toy.

Means is provided for filling and refilling the envelope 10. This means can be of any usual or preferred construction; but in the two forms of the invention shown, consists of a flexible tube or nozzle 12 which can extend outwardly from the skin 11, but which is shown in the closed, sealed, folded over condition. A pressure sensitive tape 14, or any other usual or preferred means can be used for holding the tube 12 in the sealed-off closed condition when it is not being used for filling or refilling the envelope 10.

In each form of the invention shown herein, the gas filled envelope is made up of two hemispherical-like portions 15,15 hermetically sealed to each other by a flange 16 made up of the outer edges of each of these hemispherical-like concave portions. When the envelope is positioned as seen in FIGS. 1 and 2, it can be seen to approximate the popular conception of the shape of a "flying saucer". It is to be understood, however, that gas-filled envelopes of the present invention could be made into many shapes simulating Zeppelins, blimps, footballs, soccerballs, etc. In fact, gas-filled envelopes, cells or compartments such as envelope 10 could be positioned inside of extremely light but heavier-than-air structures resembling space stations, for example, to constitute such combined structures as lift-weight balanced toys.

Means is provided for balancing the weight of the toy 8 against its lift. In the form of the invention as shown, this means is constituted as a ballast member 18 adhered to the underside of the skin 11 of a bottom concave portion 15 of the envelope 10. This ballast member 18 consists of a plurality of spirally positioned weight control modules 20, initially connected together to form the ballast member 18, but scored so as to be separable, one after the other, around the other edge of the spiral to lighten the toy in the process of establishing an equilibrium which will allow the toy to float in a lift-weight balanced condition at a desired altitude of the ground or floor.

Each of these weight control modules 20 is adhered to the skin of the toy 8 by a pressure sensitive adhesive layer 21 situated between the module and the toy, in the form of the invention shown. Some other form of adherence could be utilized, however, to allow the modules each to be removed and, then, when desired, to be readhered to the bottom concave member 15 of the envelope 10. For example, Velcro fasteners could be provided on the lower surface of the envelope 10 and on the upper surface of each weight control module 20.

While in the form of the invention as shown, the ballast member 18 approximates a true spiral, it is to be understood that the configuration of the weight-control modules which make up a ballast member could constitute a contiguous strip or block in the shape of a rectangle, a triangle, or other polygon, or could take on any number of other designs as long as the weight-control modules are positioned to be serially removable from the remainder of the ballast member in an order so as not to appreciably change the center of gravity of the parts of the ballast member remaining.

In order to achieve the accurate horizontal alignment of the flange 16 as in seen in FIG. 1 when the toy is airborne, an additional weight 22, exactly equal to the combined weight of the flexible tube 12 and the pressure sensitive tape 14, can be adhered to the envelope in exact symmetrical balance across the envelope 10 from the tube and the tape; or the ballast member 18 can be situated slightly off balance with respect to the exact bottom of the bottom concave portion 15 of the envelope 10 to counterbalance the weight of the tube 12 and tape 14.

Operation of First Embodiment:

The envelope 10 is filled with a lighter-than-air gas 13 such as helium, for example, through the flexible tube 12 from a source not shown. This filling will continue until the envelope 10 reaches its maximum dimension, and, in most cases, some additional gas will be inserted to render the pressure of gas inside of the envelope initially greater than the pressure of the ambient atmosphere. The flexible tube will then be sealed off and held in sealed position by application of pressure sensitive tape 14, or by any other usual or preferred means.

Sufficient ballast 18 is initially provided with each airborne toy so that lift-weight equilibrium of the toy can be achieved at any above ground altitude on the surface of the earth and at any barometric pressure. In the usual case, therefore, it will be necessary to remove one or more of the weight control modules 20 by breaking them off from the ballast member 18 and simultaneously breaking their adherence with respect to the skin of the envelope 10. After each such module is removed, the toy will be momentarily released to see if it begins to fall or to rise or if it is, as desired, lift-weight balanced and stays at the altitude for which it is being adjusted.

It has been found that such accurate adjustment can be obtained in this manner that the toy can be made to float closely adjacent to the floor to be used by a small child and can be made to float at a greater distance from the floor to be most useful and entertaining for larger children and adults.

As helium eventually escapes from the envelope 10, additional weight control modules can be removed to once again establish balance at the desired altitude above the ground or floor level.

Since the pressure inside of the envelope 10 will, be very gradual loss of helium, eventually exactly equal the pressure around it in the ambient atmosphere, there will be very little, if any, tendency for further helium to escape, and the balance achieved by the toy at that point will last for a very long time indeed. In this form, the Mylar or other material of the skin 11 of the envelope 10 will have no forces acting on it to push it in or to push it out, and so this skin will act as a substantially rigid member. Thus, to the extent that the skin is impermeable to air on one side and to the lighter-than-air gas on the other, the toy will tend to be in permanent balance.

The weight modules 20 may also be used to adjust for any substantial variations in the barometric pressure occurring in the area of the toy.

Figure 3:
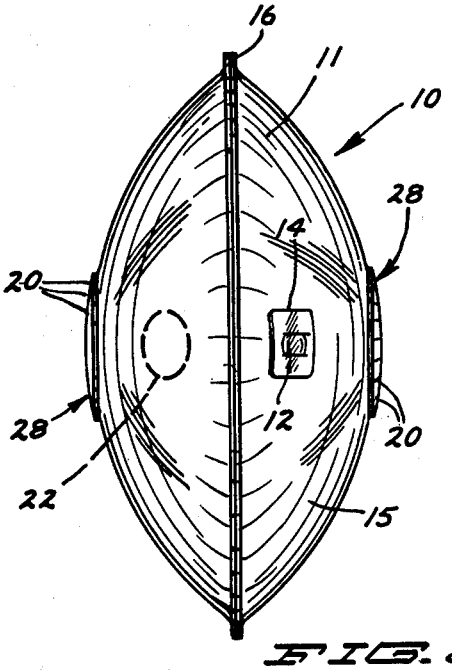
FIG. 3 is a front edge view of an airborne, floating, lift-weight balanced toy made according to a second form of the invention.
Figure 4:
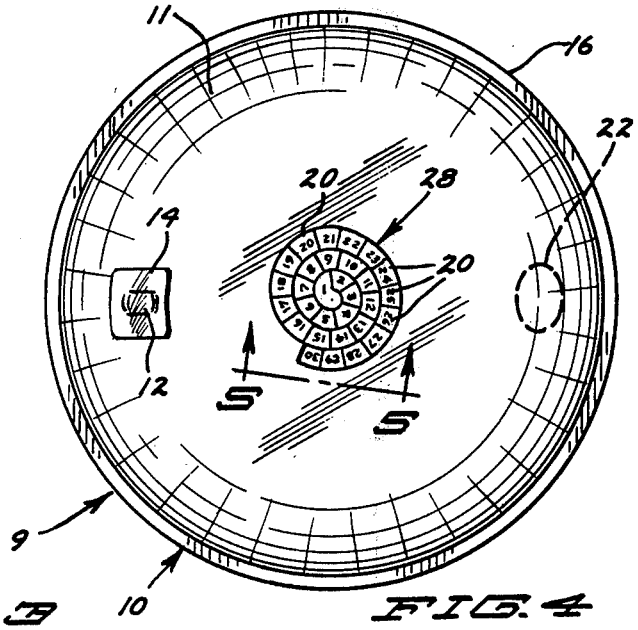
FIG. 4 is a side elevational view of the toy of FIG. 3.

Second Form of the Invention:

As seen in FIGS. 3, 4 and 5, an airborne, floating, lift-weight balanced toy 9 includes the same gas filled envelope, cell or compartment 10 made up of a skin 11 which is in the form of two hemispherical-like concave portions 15,15 joined together by a flange 16 made up of the outer edges of these concave portions.

In the second form of the invention, however, two ballast members 28,28 are adhered to the envelope 10, one on the center of each of the concave portions 15,15 of the envelope.

These ballast members 28,28 will be placed very accurately so that they will have an exact balanced relationship with respect to each other when the envelope 10 is filled with a lighter-than-air gas 13.

In order to keep the toy in exact balance to maintain the flange 16 in a vertical plane once it is placed there, the weight control modules 20 can be identically numbered on each side of the toy so that they can be removed or added in matched pairs and thus will always be exactly the same.

As stated above, the weight control modules which make up a ballast member need not be removed in spiral order. For example, the order of removal of the weight control modules 20 as seen in FIGS. 3 and 4, could be by pairs numbered 30, 22, 25, 17, 29, 21, . . . 6, 3, 4, 2, 5 and 1 and the static balance of the envelope 10 would not be appreciably disturbed.

Exact static balance of the airborne toy 9 of the second form of the invention is achieved by adhering a weight 22 to the toy exactly diametrically opposite from the flexible tube 12 and pressure sensitive tape 14 to exactly counterbalance them.

Operation of Second Form of the Invention:

Lighter-than-air gas will be introduced inside of the envelope 10 to bring it to its full size, and, initially sufficient of this gas can be introduced to provide a slight positive pressure inside of the envelope. The envelope will be sealed, and sufficient pairs of weight control modules 20 will be removed, one from each side of the envelope 10, until lift-weight balance or equilibrium at the desired altitude is obtained. When more altitude is required or desired, one module will be removed from each side of the toy. When less altitude is desired, one module will be added back on to each side, to maintain the balance.

With this lift-weight balance achieved to maintain a particular altitude, the toy will maintain the position as seen in FIGS. 3 and 4 if placed in that position in still air. However, when thrown, or in air currents, the toy will tumble freely as do the utensils and articles and the men themselves in a spacecraft in weightless space.

The embodiments of the invention in which an exclusive property or privilege is claimed are defined as follows:

1. In an airborne, free floating, lift-weight balanced object for use as a manually manipulable amusement device, said object having: (a) a closed envelope encompassing a volume of lighter-than-air gas, said envelope being made of an unstretchable skin which is substantially impervious to the passage of said gas therethrough, and having: (b) ballast means fixed in position with respect to the envelope to tend to balance the weight of the object to equal the lifting effect of the gas; the improvement including:

A. at least one ballast member adapted to be adhered to the object fixedly with respect to the skin of the envelope, said ballast member being constituted as a plurality of weight control modules spirally arranged with respect to each other, each of said weight control modules initially lying in contiguous relation to its immediately adjacent modules along the spiral path and in contiguous relation to its immediately adjacent modules forming parts of the next adjacent inward and outward spiral loops, all of the modules initially forming a continuous ballast member sheet from a first weight control module positioned in adjacent relation to the center of a spiral to a last weight control module positioned in contiguous relation to the next-to-the-last module and in contiguous relation to the next inward spiral loop;

B. fastening means operative to cause said modules to adhere in fixed position with respect to the skin of the envelope, to allow said modules to be removed from said fixed position with respect to said skin, and to cause said modules to readhere in fixed position with respect to said skin;

C. said modules being serially removable from their fixed position with respect to the skin from the outer end of the spiral toward the inner end thereof;

D. said fastening means and said ballast member constituting at least part of said ballast means; and E. said ballast member being fastened with respect to said skin in position such that the removal from outer end toward the inner end of said spiral of one or more of said weight control modules from fixed position with respect to the skin of the envelope will not appreciably affect the static balance of the object.

2. The structure of claim 1 wherein:

F. said object is static balanced to have one portion constantly constituted as the bottom portion thereof; and G. said ballast member is fastened with respect to said skin in position to cause said bottom portion to remain as or to return to position as the undermost portion of the object by action of gravity when said free-floating object is free of manual manipulation and other external forces.

3. The structure of claim 1 wherein:

F. said object is in complete static balance such that it will remain in the attitude in which it is placed when free of manual manipulation or other external forces except gravity; and G. at least two ballast members are fixed in symmetrical relation to the object such that removal of matched sets of weight control modules, one from each ballast member, will not disturb this complete static balance.

4. In an airborne, free floating, lift-weight balanced object for use as a manually manipulable amusement device, said object having: (a) a closed envelope encompassing a volume of lighter-than-air gas, said envelope being made of an unstretchable skin which is substantially impervious to the passage of said gas therethrough, and having: (b) ballast means fixed in position with respect to the envelope to tend to balance the weight of the object to equal the lifting effect of the gas; the improvement including:

A. at least one ballast member adapted to be adhered to the object fixedly with respect to the skin of the envelope, said ballast member being constituted as a plurality of weight control modules spirally arranged with respect to each other;

B. fastening means operative to cause said modules to adhere in fixed position with respect to the skin of the envelope, to allow said modules to be removed from said fixed position with respect to said skin, and to cause said modules to readhere in fixed position with respect to said skin;

C. said modules being serially removable from their fixed position with respect to the skin from the outer end of the spiral toward the inner end thereof;

D. said fastening means and said ballast member constituting at least part of said ballast means; and E. said ballast member being fastened with respect to said skin in position such that the removal from outer end toward the inner end of said spiral of one or more of said weight control modules from fixed position with respect to the skin of the envelope will not appreciably affect the static balance of the object.

5. The structure of claim 4 wherein:

F. said object is static balanced to have one portion constantly constituted as the bottom portion thereof; and G. said ballast member is fastened with respect to said skin in position to cause said bottom portion to remain as or to return to position as the undermost portion of the object by action of gravity when said free floating object is free of manual manipulation and other external forces.

6. The structure of claim 4 wherein:

F. said object is in complete static balance such that it will remain in the attitude in which it is placed when free of manual manipulation or other external forces except gravity; and G. at least two ballast members are fixed in symmetrical relation to the object such that removal of matched sets of weight control modules, one from each ballast member, will not disturb this complete static balance.

7. In an airborne, free floating, lift-weight balance object for use as a manually manipulation amusement device, said object having: (a) a closed envelope encompassing a volume of lighter-than-air gas, said envelope being made of an unstretchable skin which is substantially impervious to the passage of said gas therethrough, and having: (b) ballast means fixed in position with respect to the envelope to tend to balance the weight of the object to equal the lifting effect of the gas; the improvement including:

A. at least one ballast member adapted to be adhered to the object fixedly with respect to the skin of the envelope, said ballast member being constituted as a plurality of weight control modules arranged in a series of contiguous rings;

B. means operative to cause said modules to be initially fastened in fixed position with respect to the skin of said envelope, to allow said modules to be removed from said fixed position with respect to said skin, and to cause said modules to be refastened in fixed position with respect to said skin;

C. said modules being serially removable from their fixed position with respect to the skin from the outer ring toward the inner ring;

D. said fastening means and said ballast member constituting at least part of said ballast means; and E. said ballast member being fastened with respect to said skin in position such that the removal of one or more of said weight control modules from a fixed position with respect to the skin of the envelope from the outer ring toward the inner ring will not appreciably effect the static balance of the object.

* * * * *